United States Patent [19]

Kobayashi et al.

[11] Patent Number: 5,021,291

[45] Date of Patent: Jun. 4, 1991

[54] MULTIPLE-TIME INK-BEARING MEDIUM FOR THERMAL PRINTING

[75] Inventors: Tetuo Kobayashi, Yokkaichi; Mikio Imaeda, Biasi, both of Japan

[73] Assignee: Brother Kogyo Kabushiki Kaisha, Nagoya, Japan

[21] Appl. No.: 364,592

[22] Filed: Jun. 12, 1989

Related U.S. Application Data

[60] Continuation of Ser. No. 114,284, Oct. 29, 1987, abandoned, which is a division of Ser. No. 772,680, Sep. 5, 1985, Pat. No. 4,769,258.

[30] Foreign Application Priority Data

Sep. 12, 1984 [JP] Japan ..... 59-191312
Sep. 12, 1984 [JP] Japan ..... 59-191313

[51] Int. Cl.[5] ..... B41M 5/26

[52] U.S. Cl. ..... 428/319.9; 428/211; 428/321.3; 428/335; 428/336; 428/411.1; 428/484; 428/488.1; 428/501; 428/508; 428/515; 428/519; 428/522; 428/704; 428/913; 428/914

[58] Field of Search ..... 428/195, 211, 321.3, 428/335, 336, 446, 484, 488.1, 913, 914, 319.9, 411.1, 412, 473.5, 480, 501, 508, 515, 519, 522, 704

[56] References Cited

U.S. PATENT DOCUMENTS 4,609,928 9/1986 Kubo et al. ..... 503/208

FOREIGN PATENT DOCUMENTS 0063000 10/1982 European Pat. Off. ..... 503/200
138483 4/1985 European Pat. Off. ..... 428/488.4
54-68253 6/1979 Japan ..... 503/200
55-105579 8/1980 Japan ..... 503/200
57-160691 10/1982 Japan ..... 503/200

OTHER PUBLICATIONS

Findlay et al., "Ribbon Support Film Coating", IBM Technical Disclosure Bulletin, vol. 15, No. 2, Jul., 1972.

*Primary Examiner*—Pamela R. Schwartz
*Attorney, Agent, or Firm*—Oliff & Berridge

[57] ABSTRACT

A multiple-time ink-bearing medium containing a thermally-transferable ink for thermal printing, produced in a process comprising: preparing a resin solution of a water-soluble resin comprising polyvinyl alcohol as a major constituent; preparing a fusible ink material consisting of a mixture which includes a solid fatty acid as a major constituent, a coloring agent, and a fusible agent having a low melting point; finely dispersing the ink material in the resin solution, so as to provide an ink-layer composition; applying the ink-layer composition to one surface of a substrate; and drying the applied ink-layer composition to form an ink layer on the substrate.

15 Claims, 4 Drawing Sheets

OPTICAL DENSITY P
OF PRINTED IMAGE 1.0
0.5
0.1
0
A
B
C
5
10
15
NUMBER OF USE OF THERMAL PRINT SHEET

OPTICAL DENSITY P
OF PRINTED IMAGE 1.0
0.5
0.1
0
A
B
C
5
10
15
NUMBER OF USE OF THERMAL PRINT SHEET

MULTIPLE-TIME INK-BEARING MEDIUM FOR THERMAL PRINTING

This is a continuation of application Ser. No. 114,284, filed Oct. 29, 1987, now abandoned, which in turn is a division of Ser. No. 772,680, filed Sept. 5, 1985, now U.S. Pat. No. 4,769,258.

BACKGROUND OF THE INVENTION

1. Field of the Art

The present invention relates to a multiple-time ink-bearing medium containing a thermally transferable ink material, which is used for a thermal printer.

2. Related Art Statement

In the field of thermal printing, there has been used a thermal print ribbon made of a sheet (hereinafter referred to as "thermal print sheet") which comprises a substrate, and a layer of a thermally-fusible and- transferable ink composition formed on one surface of the substrate. The ink composition consists of a coloring agent and a binder. In use, the ink composition on the heated portions of the print ribbon is transferred to a recording sheet of paper. Therefore, the thermal print ribbon, once used, can not serve again, namely, the same area of the print ribbon cannot be used two or more times. Accordingly, such a "one-time" or "single-use" thermal print ribbon is not economical to use.

To overcome the above economical drawback, the following three different types of thermal print sheets for multiple-time thermal print ribbons have recently been proposed:

The first proposed thermal print sheet is disclosed in Japanese Patent Application which was laid open in 1982 under Publication No. 57-160691. This print sheet for a multiple-time thermal print ribbon is prepared by mixing carbon black or other coherent or coagulant powder into an ink composition which consists of a fusible dye and a material having a low melting point, and by applying the mixture to a substrate. The carbon black or similar coherent powder contained in such a thermal print sheet does not at all contributes to formation of an image, that is, the image is formed by the fusible dye.

Since images to be formed by dyes tend to be easily faded, the above thermal print sheet suffers from a problem of permanency of a printed image, i.e., does not provide a long life of printed documents.

The second proposed thermal print sheet for a thermal print ribbon comprises an ink-impregnated layer of heat-resistant resin formed on a substrate, which resin layer has a large number of continuous small pores or voids filled with a fusible ink. This thermal print sheet or ribbon is disclosed in Japanese Patent Application laid open in 1980 under Publication No. 55-105579. However, this type of thermal print sheet requires complicated steps for forming the porous resin layer on the substrate, and is difficult to efficiently impregnate the porous resin layer with the fusible ink with uniform distribution.

Accordingly, the second proposal suffers from low uniformity of optical density of printed images, and therefore fails to provide satisfactory printing quality.

The thermal print sheet of the third proposal is prepared by using a solution of a resin in which an ink material is dissolved and/or dispersed. This solution is applied to a substrate, and the solvent in the coating is evaporated. As a result, a finely porous layer of the resin is obtained, which contains masses of fusible ink. This method is disclosed in Japanese Patent Application laid open in 1979 under Publication No. 54-68253.

However, any of the thermal print sheets disclosed in the document indicated just above requires an extremely larger amount of energy input to fuse the ink material, than the conventional thermal print sheet for a one-time thermal print ribbon.

SUMMARY OF THE INVENTION

It is accordingly an object of the present invention to provide an ink-bearing medium containing a thermally-transferable ink material, which is usable several times, and which permits a thermal printing with reduced input energy, and with increased optical density of printed images, and improved uniformity of optical density of the images.

Another object of the invention is to provide a simple process of producing such a multiple-time ink-bearing medium, at a minimum cost.

A further object of the invention is to provide such a multiple-time ink-bearing medium which has a long shelf life and permits a thermal printing without soiling a recording medium with an ink material, and to provide a process for producing the same.

According to the present invention, there is provided a process of producing a multiple-time ink-bearing medium containing a thermally-transferable ink for thermal printing, comprising the steps of: preparing a resin solution of a water-soluble resin comprising polyvinyl alcohol as a major constituent; preparing a fusible ink material consisting of a mixture which includes a solid fatty acid as a major constituent, a coloring agent, and a fusible agent having a low melting point; finely dispersing the ink material in the resin solution, so as to provide an ink-layer composition; applying the ink-layer composition to one surface of a substrate; and drying the applied ink-layer composition to form an ink layer on the substrate.

According to the invention, there is also provided a multiple-time ink-bearing medium containing a thermally-transferable ink for thermal printing, comprising: a substrate; a porous resin layer formed on the substrate and formed of a water-soluble resin comprising polyvinyl alcohol as a major constituent, the porous resin layer having a multiplicity of continuous pores of less than 6 microns; and a fusible ink material contained in the multiplicity of continuous pores in the porous resin layer, the fusible ink material consisting of a mixture which includes a solid fatty acid as a major constituent, a coloring agent, and a fusible agent having a low melting point.

The ink-bearing medium of the invention constructed as described above may be produced at a reduced cost according to the process of the invention previously described, that is, by simply mixing the prepared resin solution and ink material to obtain an ink-layer composition, applying the obtained ink-layer composition to a substrate and drying the applied ink-layer composition. In the thus produced ink-bearing medium, the fusible ink material is contained in the multiple continuous pores formed in the porous resin layer. Since the ink material is finely dispersed in the resin solution, particles of the ink material are uniformly distributed throughout the porous resin layer, whereby the optical density of images printed through the instant ink-bearing medium is made uniform. Further, the porous structure of the porous resin layer serves as a barrier to restrict migration or flow of the molten ink material toward the surface of the ink layer while the ink layer is heated for transfer of the ink material to a recording medium. This restriction of migration of the ink material enables the same area of the ink layer to be used several times. Furthermore, the composition of the ink material according to the invention permits the fusion or melting of the ink material with a reduced thermal energy input to a thermal print head. In addition, the continuous network of the ink particles in the continuous porous structure of the resin layer prevents a waste of a portion of the ink material adjacent to the substrate.

According to an advantageous embodiment of the invention, said solid fatty acid is a saturated fatty acid which is expressed by the formula: $CH_3(CH_2)_nCOOH$, where n is from 14 through 20 inclusive. In this embodiment, the fused ink material will not soil the recording medium, and the shelf life of the ink-bearing medium is improved.

BRIEF DESCRIPTION OF THE DRAWING

The foregoing and other objects, features and advantages of the present invention will become more apparent from reading the following detailed description, when considered in connection with the accompanying drawing, in which.

DETAILED DESCRIPTION OF THE INVENTION

The invention will be described in greater detail, with reference to the accompanying drawing.

Figure 1:
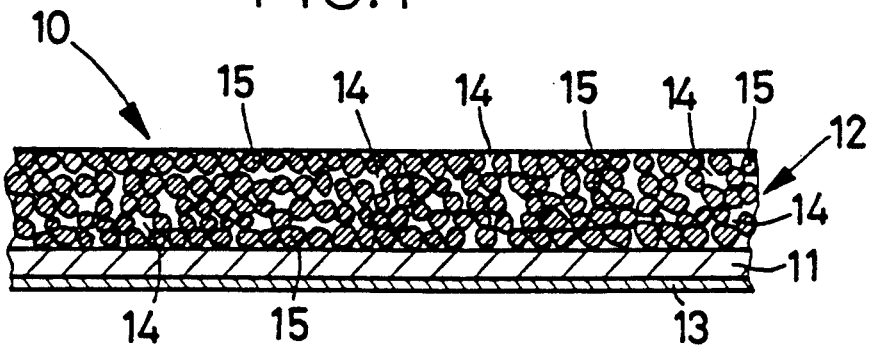
FIG. 1 is a fragmentary schematic view in cross section of one form of an ink-bearing medium for thermal printing, embodying the present invention.

There is schematically shown in a fragmentary cross sectional view of FIG. 1 an ink-bearing medium 10 containing a thermally-transferable ink for thermal printing, which medium 10 can be used multiple times. The ink-bearing medium 10 is a laminar structure which includes a substrate 11, and an ink layer 12 which is carried by the substrate 11 and contains a thermally fusible and transferable ink material which will be described. The substrate 11 is prepared from a film, condenser paper, glassine paper, or the like which has a minimum heat resistance of 150° C. The film may be made of polyester, polyimide, polycarbonate, polysulfone, polyether sulfone, polyphenylenesulfide, polyether-ether ketone. Preferably, the thickness of the substrate 11 ranges from from about 3 microns to about 20 microns. For preventing the substrate 11 from sticking to printer's heat-generating elements (which will be described), the substrate 11 is covered, on its surface remote from the ink layer 12, with an anti-tack layer 13 made of silicon or a heat-resistant resin.

The ink layer 12 consists of water-soluble resin 14 (water-soluble high molecules) whose major constituent is polyvinyl alcohol, and fusible ink particles 15.

While the water-soluble resin 14 may be made wholly of polyvinyl alcohol, the addition of a suitable amount of polyethylene glycol will improve the transferability of the ink particles 15 to a recording medium on which printing is effected. The polyethylene glycol may be replaced by a water-soluble resin which is selected from a group comprising: methyl cellulose; ethyl cellulose; hydroxyethyl cellulose; hydroxypropyl cellulose; carboxymethyl cellulose; polyvinyl pyrrolidone; sodium polyacrylate; polyacrylamide; styrene-maleic anhydride copolymer; and isobutylene-maleic anhydride copolymer.

The ink particles 15 are made of a mixture which consists of a solid fatty acid as a major constituent, a coloring agent, a highly fusible agent, and other suitable additives as needed. The solid fatty acid, which is solid at normal or room temperatures, may be at least one of the following acids: lauric acid, myristic acid, palmitic acid, margaric acid, stearic acid, nonadecanoic acid, arachic acid, and behenic acid. For preventing a recording medium from being soiled with the ink, and for increased shelf life of the ink-bearing medium, it is preferred to use a saturated solid fatty acid which is defined by the following formula:

$$CH_3(CH_2)_nCOOH,$$

where n=14 through 20 inclusive. In particular, it is recommended to use palmitic acid, margaric acid, stearic acid, nonadecanoic acid, arachic acid, behenic acid, etc.

As will be described referring to experimental results, the proportion of the solid fatty acid to the sum of the solid fatty acid and the fusible agent is adjusted preferably within a range of 40–95%.

The fusible agent is a water-insoluble, waxy material having a melting point of 40°–100° C., which is selected from a group comprising: paraffin wax; microcrystalline wax; oxidized paraffin wax; candelilla wax; carnauba wax; montan wax; ceresine wax; polyethylene wax; oxidized polyethylene wax; castor wax; beef tallow oil; lanolin(e); vegetable tallow; sorbitan stearate; sorbitan palmitate; stearyl alcohol; polyamide wax; oleyramide; stearyramide; 12-hydroxystearic acid; synthetic ester wax; and (synthetic) metallic soap. In place of these waxy materials, the following thermo-plastic materials having a low melting point may be used: petroleum resin; rosin; ester gum; ketone resin; epoxy resin; ethylene-vinyl acetate copolymer resin; and ethylene-a-oleffin copolymer resin.

The coloring agent may be an organic or inorganic pigment such as carbon black, Lake Red, Alkali Blue Toner, and Prussian blue. An oil-soluble or basic dye which is highly soluble in a solid fatty acid, such as Nigrosine, Oil Black and Methyl Violet, may be used as an aid added to the pigment, for obtaining colors, hues or tones which are not produced solely by the pigment.

For improved dispersion of the coloring agent in the low-melting-point material, a suitable dispersant such as lecithin may be added during preparation of a mixture for the ink particles 15.

The thus prepared material for the ink particles 15 (hereinafter referred to as "ink material") is introduced into a solution of the previously indicated water-soluble resin for the resin layer 14 (hereinafter called "resin solution") comprising polyvinyl alcohol as a major constituent, while the ink material and the resin solution are heated and the resin solution is stirred. Thus, the mixture is emulsified. For better emulsification of the mixture, a surface active agent of Span type (available from Atlas Powder Co.) a major component of which is sorbitan fatty acid ester is added to the ink material. Preferably, sorbitan stearate, distearate, tristearate or other surface active agent which is solid at the room temperature, is used. In the meantime, a surface active agent of Tween type (available from Atlas Powder Co.), or polyoxyethylene alkylether may be added to the solution of the water-soluble resin. The "Tween" is fatty acid ester from polyoxyethylene sorbitan. Since the resin solution has a relatively high viscosity, and may be sufficiently emulsified, it is not essential to add such surface active agents as an emulsifier to the resin solution.

The temperature at which the ink material and the resin material are mixed and emulsified should be higher than a melting point of the ink material, so that the emulsification may take place in liquid-liquid state (while the ink material is in a liquid state) for uniform emulsification throughout the mixture. Further, the stirring of the resin solution is important for optimizing the grain size of the ink material (4–5 microns) after the emulsification, and for obtaining uniform distribution of grain size of the entire mixture system.

In this manner, an emulsion of the composition for the ink layer 12 (hereinafter referred to as "ink-layer composition") to be applied to one surface of the substrate 11 may be easily prepared. Due to the emulsification of the mixture as described above, the prepared ink-layer composition has finely divided ink particles of more uniform size which are dispersed more uniformly, than a composition which is prepared according to a known process by means of mechanical milling as with a ball mill.

The prepared emulsion of ink-layer composition is diluted as needed with a suitable diluent such as ethyl alcohol, and then applied to the substrate 11 by using a suitable coating device such as a reverse roll coater, gravure coater, rod coater, roll coater, or blade coater. The thickness of the coating will affect the inking capability of the ink-bearing medium 10. The substrate 11 may be pre-coated with a binder layer of acrylic or vinyl chloride resin, or similar material having an affinity to the ink-layer composition.

The substrate 11 coated with the ink-layer composition is introduced into a drier, and the aqueous component of the composition is removed by evaporation. The drying temperature is held within a range of 80°–120° C., i.e., higher than the melting point of the fusible agent contained in the ink material in the coating of ink-layer composition, so that the ink material may be condensed in the drying process, to such an extent that permits the ink material to form a continuous chain or network of the ink particles 15 in the ink layer 12, as shown in FIG. 1.

Thus, the substrate 11 of the multiple-time ink-bearing medium 10 is provided with the ink layer 12 which contains the fusible, continuous, finely divided ink particles 15 of substantially uniform size (less than several microns) which are uniformly dispersed or distributed in the water-soluble resin layer 14 of a porous structure having a multiplicity of continuous fine pores or voids. Namely, these pores in the resin layer 14 accommodate or contain the ink particles 15 of the corresponding sizes.

Figure 2:
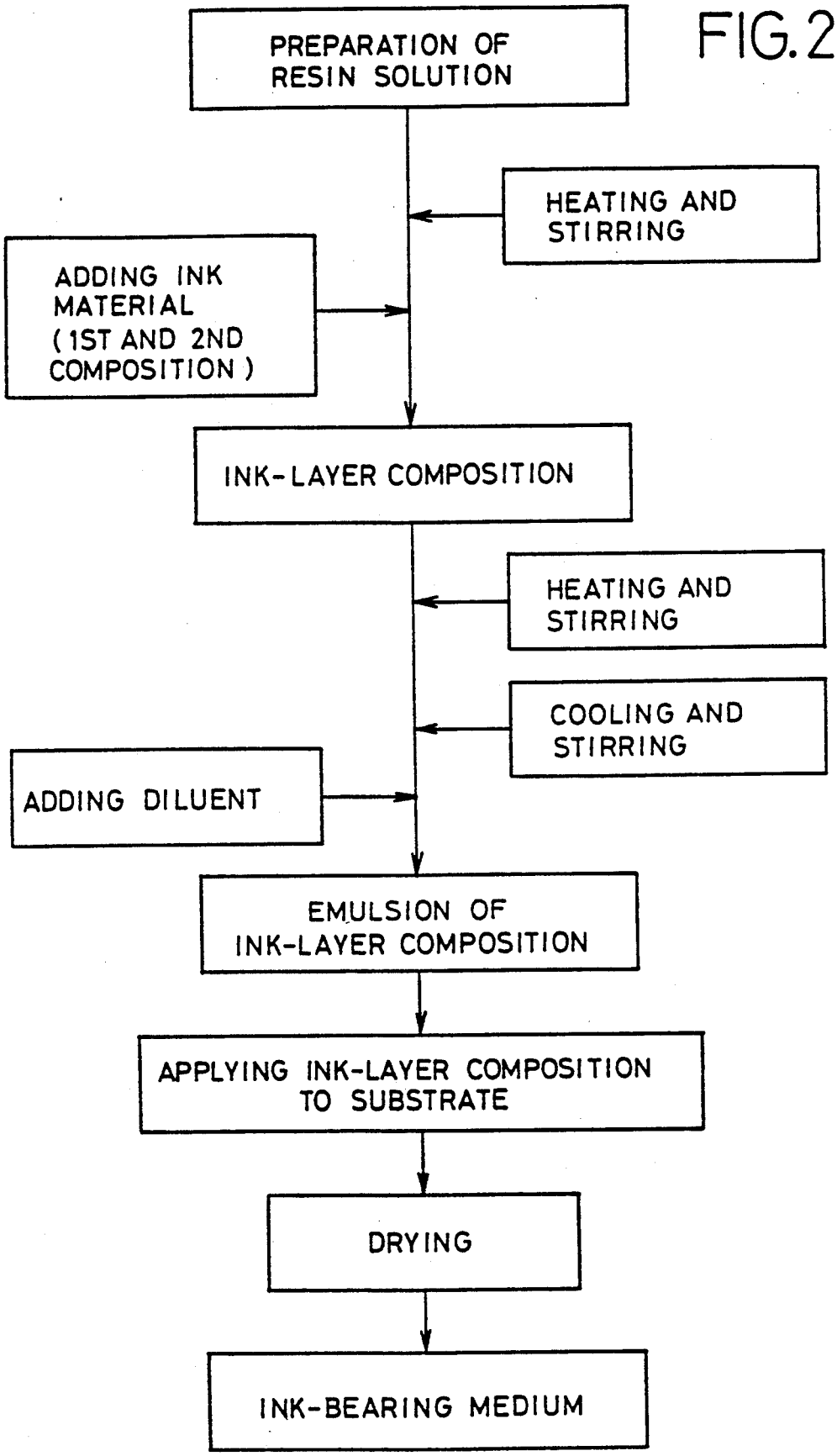
FIG. 2 is a flow chart showing one embodiment of a process of the invention for producing the ink-bearing medium.

Referring next to FIG. 2, a process of producing the ink-bearing medium 10 according to the invention will be described.

(1) Preparation of "Ink Material"

Initially, a pigment and a fusible agent are mixed and milled at a temperature higher than the melting point of the fusible agent, for example, at about 70° C. or higher. For milling, a commonly used mill is used, such as a three-roll mill, centri mill, sand mill, ball mill, or cowles dissolver. The milling temperature should be higher than the melting point of the fusible agent, for melting the fusible agent and thereby dispersing the coloring agent uniformly in the melt. For convenience, the obtained mixture is hereinafter referred to as the "first composition" of the ink material.

In the meantime, a solid fatty acid and a dye are heated to around 100° C., and mixed with stirring. The obtained mixture (hereinafter referred to as the "second composition" of the ink material) is introduced, under heat and with stirring, into the first composition. At the same time, a suitable surface active agent of Span type is added. In this manner, the ink material is prepared.

(2) Preparation of Solution of Water-Soluble Resin

Polyvinyl alcohol and a small amount of other water-soluble resins are dissolved in warm water. A surface active agent of Tween type is added in a suitable amount to the solution. Thus, the resin solution consisting primarily of polyvinyl alcohol is prepared.

(3) Preparation of Ink-Layer Composition (Emulsification of Resin Solution and Ink Material)

The ink material held at the previously indicated milling temperature is added, dropwise at a slow rate, to the resin solution in a bath at a temperature in the neighborhood of 80° C. while the solution is stirred at a high speed. The addition of the ink material is continued until its proportion reaches a desired level. The mixture is continously stirred vigorously for an additional time. Immediately after the vigorous stirring is changed to a gentle stirring, the mixture is cooled to the room temperature by means of an external refrigerant. Thus, an emulsion of the ink-layer composition is prepared.

(4) Adjustment of Ink-Layer Composition

A suitable amount of a diluent is introduced at a slow rate to the obtained emulsion of ink-layer composition while the emulsion is stirred. After the introduction of the diluent, the mixture is further stirred, and thus a coating liquid of the ink-layer composition is obtained. It will be understood that this coating liquid contains the ink material in the form of fine particles which are uniformly dispersed in a solution consisting of the water-soluble resin components and the diluent.

(5) Application of the Coating Liquid

The coating liquid of the ink-layer composition is applied to one surface of the substrate 11 by a suitable coating device previously indicated. The thickness of the coating should be several times larger than the thickness of the ink layer 12 which is obtained after evaporation of the aqueous component (solvent of the solution) of the coating in the subsequent drying process. For example, the thickness of the coating is selected within a range of 30–100 microns.

(6) Drying of the Coating

Finally, the substrate 11 coated with the green ink layer is introduced into a drier at 80°-120° C., in order to evaporate the water remaining as the solvent and the diluent. In addition to removal of the water, this drying step will contribute to formation of a continuous network of the fusible fine ink particles 15 within a finely porous structure of the water-soluble resin layer 14, as previously described. The resin layer 14 and the ink particles 15 contained therein form the ink layer 12 whose thickness is generally from 5 to 30 microns.

As described hitherto the multi-time ink-bearing medium 10 of FIG. 1 is produced.

While the illustrated process is adapted to disperse the ink material in the resin solution by means of emulsification, it is possible that the ink material consisting of the first and second compositions is first roughly ground and the thus ground ink material and the resin solution are introduced in a ball mill for dispersion of the ink material in the resin solution.

The following experiment was conducted to determine a suitable proportion of a solid fatty acid with respect to a fusible agent.

| Experiment | |
|---|---|
| A. Ink Material | 18 parts by weight |
| Stearic acid | X wt. % |
| Candelilla wax | Y wt. % |
| Black dye | 13 wt. % |
| Carbon black | 6 wt. % |
| TOTAL | 100 wt. % |
| B. Polyvinyl Alcohol Solution | 50 parts by weight |
| C. Ethyl Alcohol | 70 parts by weight |

Figure 4:
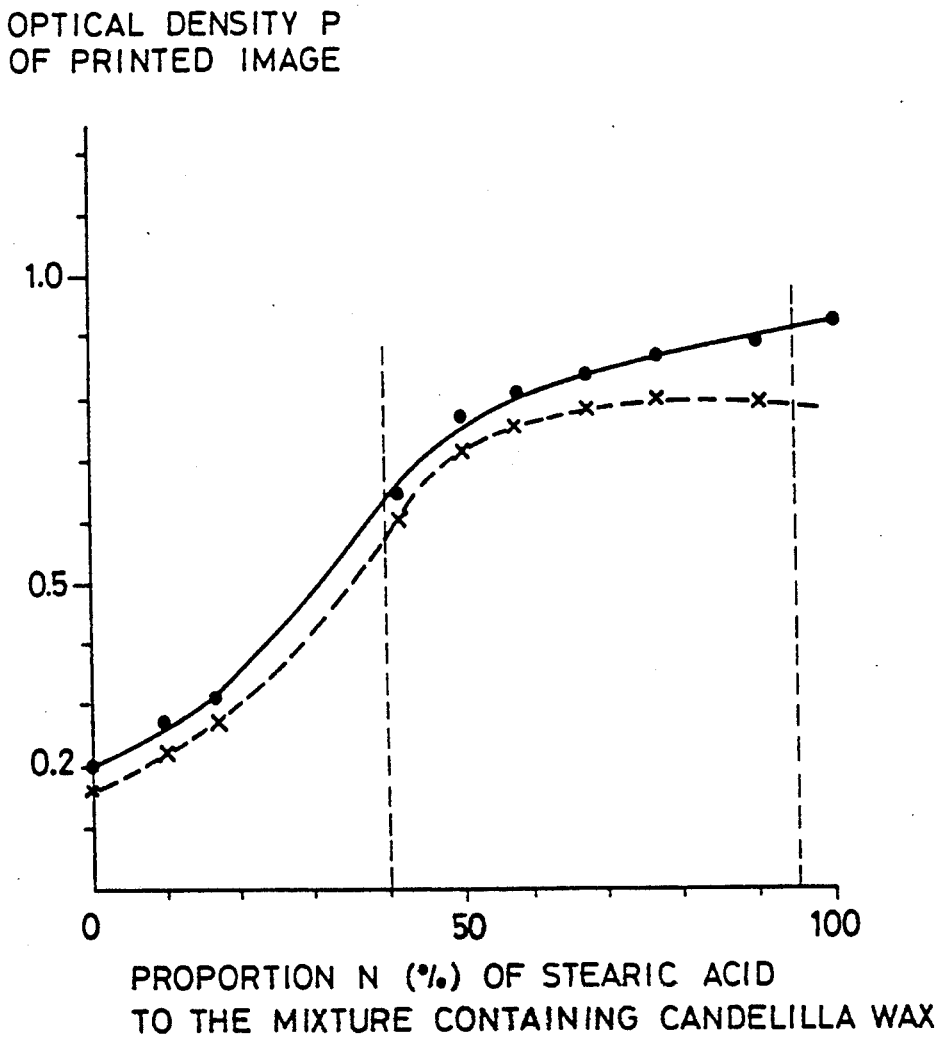
FIG. 4 is a graph showing a relation between a proportion of a solid fatty acid to a fusible agent, and an optical density of an image printed by an ink material containing these components.

Ink-bearing mediums were produced according to the above-described process, with different proportions of the stearic acid (X % as a solid fatty acid) to the candelilla wax (Y % as a fusible agent). The produced ink-bearing mediums were used for printing on a sheet of paper having a Bekk smoothness of 60 secs., by a thermal print head with thermal energy input of 30 m J/mm$^2$. The optical density P of a printed image and the uniformity of density were increased as the proportion N of the content X % of the solid fatty acid to the sum of the content X % of the solid fatty acid and the content Y % of the fusible agent was increased, as indicated in FIG. 4. Particularly, the ink-bearing mediums prepared with a 40–95% proportion of the solid fatty acid, were found practically satisfactory. However, the ink-bearing mediums prepared without a fusible agent (with 100 % solid fatty acid) underwent a partial or local separation of the ink layer 12 from the substrate 11 during a printing operation.

The optical density P indicated in FIG.4 was measured by a commonly used optical reflection density meter, and is expressed by the following equation:

$$P=\log(100/R)$$

where, R: reflectance of light at printed images. The proportion N (%) of the solid fatty acid is expressed by the following equation:

$$N=100X/(X+Y)$$

The solid line curve in FIG. 4 represents P-N relation where the ink-bearing mediums were used for the first time, while the broken line curve represents P-N relation obtained at the fifth use of the ink-bearing mediums.

A further experiment was conducted with different kinds of solid fatty acid.

A. Lauric, Myristic and Other Solid Fatty Acids having not more than 15 Carbon Atoms ($n \leqq 13$)

With these solid fatty acids, the obtained ink layers had a low melting point and demonstrated relatively high tackiness or sticky nature. Accordingly, it is considered that they easily soil the printing sheets of paper, and suffer from a relatively short shelf life.

B. Palmitic, Margaric, Stearic, Nonadecanoic, Arachic, Behenic and Other Acids having Carbon Atoms of 16 through 22 ($14 \leqq n \leqq 20$)

Figure 5:
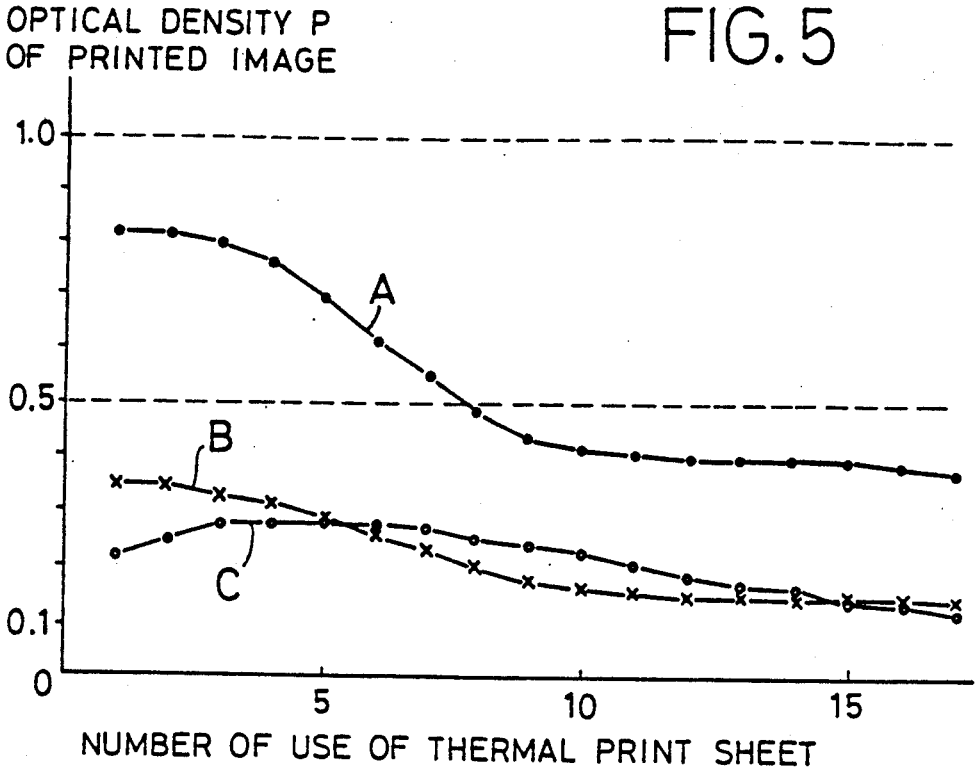
FIGS. 5 and 6 are graphs showing a relation between the optical density, and the number of use of the ink-bearing medium.
Figure 6:
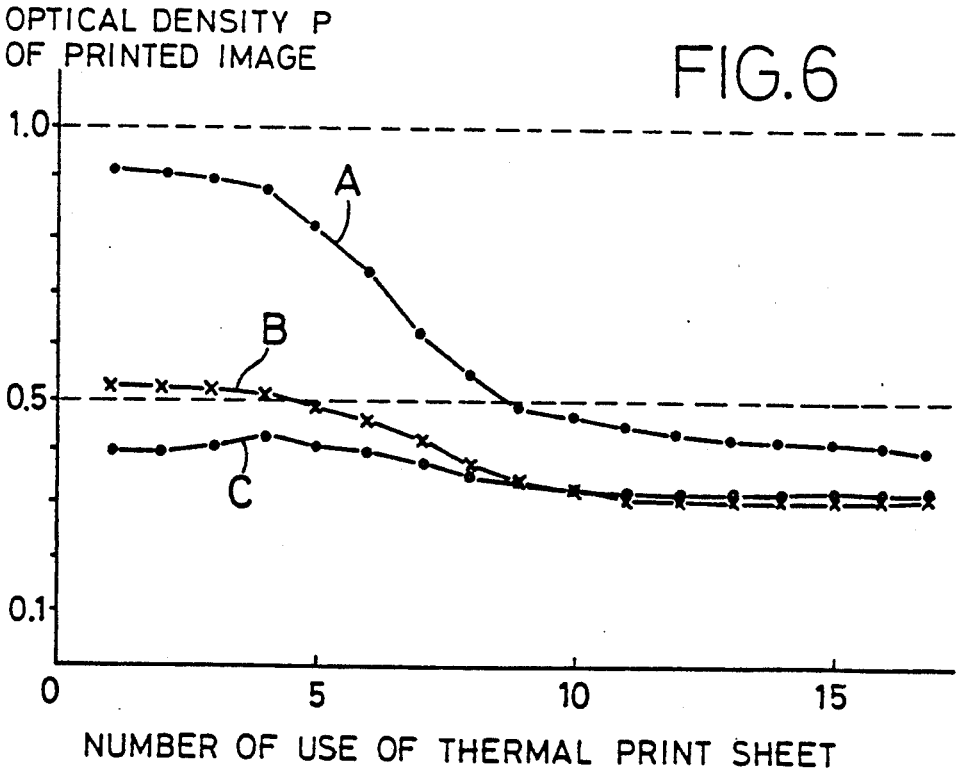

With these solid fatty acids, the obtained ink had a suitable melting point (60° through 80° C.), and were able to serve many times (as indicated in FIGS. 5 and 6), without soiling the printing sheets of paper. It is considered that the ink layers have a sufficiently long shelf life.

C. Lignoceric and Other Solid Fatty Acids having at least 23 Carbon Atoms, ($n \geqq 21$)

With these solid fatty acids, the obtained ink layers had an excessively high melting point, and required a relatively large thermal energy input. Further, the ink layers exhibited comparatively high hardness, which resulted in a larger amount of transfer (consumption) of the ink material in one use. Accordingly, these ink layers were not found suitable for repeated use or multiple-time application.

It is noted that most of the solid fatty acids having 10 or more odd-number carbon atoms do not exist naturally, and must be synthesized and are therefore expensive.

The following experiment was conducted with various different resin materials for the porous resin layer 14 which carries the ink particles 15:

A. Non-Water-Soluble Resins (a) nitrocellulose; polyester; copolymer nylon; polystylene; acrylonitrile-stylene copolymer; ABS; acrylic resins; polyvinyl butyral; or EVA With any resin selected from the above group (a), it was found substantially impossible to transfer the ink particles 15 to the printing sheets of paper.

(b) vinyl chloride; vinyl chloride-vinyl acetate copolymer; vinyl chloride-vinyl acetate-vinyl alcohol copolymer; or one of these resins in combination with a resin selected from the above group (a)

With any resin selected from the above group (b), the optical density P at the first use of the obtained ink-bearing mediums was less than 0.5. Further, it was found that the solid fatty acid was moved to the surface of the ink layer 12, and formed a thin layer of white bloom, which prevents the use of the ink-bearing medium.

B. Water-Soluble Resins (c) polyvinyl pyrrolidone; water-soluble urethane; water-soluble acrylic resin; methyl cellulose; ethyl cellulose; or stylene-maleic anhydride copolymer With any resins of the above group (c), it was found substantially impossible to transfer the ink particles 15 to the printing sheets of paper.

(d) Carboxymethyl cellulose

With this resin, the obtained resin solution had excessively high viscosity.

(e) Hydroxyethyl cellulose or hydroxypropyl cellulose

With these resins, the optical density P was around 0.5, which is considerably lower than that obtained with polyvinyl alcohol.

Thus, the above-indicated experiment revealed that a solution of water-soluble resin containing polyvinyl alcohol as a major constituent was most preferred.

To further clarify the concept of the present invention, some examples will be given below for illustrative purpose only.

EXAMPLE 1

| | |
|---|---|
| A. Ink Material | 4 parts by weight |
| Stearic acid | 60 wt. % |
| Candelilla wax | 15 wt. % |
| Sorbitan distearate | 5 wt. % |
| Carbon black (MA-7 available from MITSUBISHI KASEI KOGYO KK) | 6 wt. % |
| Oil black (Oil Black HBB available from ORIENT CHEMICAL INDUSTRIES LTD) | 9 wt. % |
| Nigrosine Base (Nigrosine Base LTGD available from BASF AG) | 4 wt. % |
| Methyl Violet (Methyl Violet Base available from HODOGAYA CHEMICAL CO LTD) | 1 wt. % |
| TOTAL | 100 wt. % |
| B. Resin Solution | 10 parts by weight |
| Polyvinyl alcohol (B-24 available from DENKI KAGAKU KOGYO KK) | 10 wt. % |
| Polyoxyethylene oleyl ether | 2 wt. % |
| Water | 88 wt. % |
| TOTAL | 100 wt. % |
| C. Diluent | 14 parts by weight |
| Ethyl alcohol | 100 wt. % |

The components of the composition A (ink material) were mixed at an elevated temperature, into an intimate and uniform mixture in a molten state. This melt was added to the resin solution of the composition B while the latter was vigorously stirred at temperatures of 75°-80° C. After the addition of the melt, the vigorous stirring was continued for 3-5 minutes, and then switched into a gentle stirring. As soon as the gentle stirring was started, the mixture was cooled to the room temperature with an external refrigerant. Successively, the diluent C was slowly added to the obtained emulsion while the latter was stirred. The mixture was sufficiently stirred and mixed into a coating liquid for the ink layer 12. The thus prepared coating liquid was applied to a substrate film of polyester by a reverse roll coater, so that the coating will have a thickness of 5-20 microns after drying. The amounts of water of the composition B and ethyl alcohol of the composition C need not be limited to the above-specified values, but may be adjusted as needed.

In the above manner, the ink-bearing mediums 10 for thermal printing application were produced, and used for thermal printing. As indicated in FIGS. 5 and 6, these ink-bearing mediums 10 were found able to be used at least 15 times. The optical density P was substantially unchanged from the first to the fourth use of the ink-bearing mediums 10. From the fifth use on, the density P was progressively lowered. However, the mediums 10 were able to maintain a practically satisfactory level of density P even after the fifteenth use.

Figure 3:
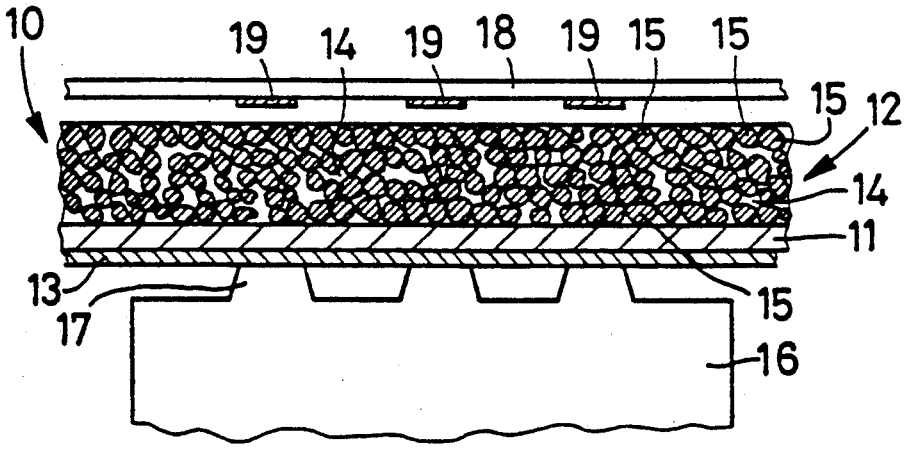
FIG. 3 is a schematic view in cross section showing the ink-bearing medium in use for thermal printing.

Referring to a schematic cross sectional view of FIG. 3, there will be described a printing operation which was effected by using the ink-bearing mediums 10 prepared according to EXAMPLE 1.

In the figure, there is shown heat-generating elements 17 of a thermal printer on which the ink-bearing medium 10 was used for thermal printing through a thermally transferable ink. The ink-bearing medium 10 is disposed such that its anti-tack layer 13 remote from the ink layer 12 is held in contact with the ends of the heat-generating elements 17 of the thermal print head 16. In this condition, the surface of the ink layer 12 of the medium 10 faces a printing surface of a sheet of paper 18 which is supported on a platen (not shown) of the printer. The heat-generating elements 17 are selectively energized to produce thermal energy, while the thermal print head 16 is moved along the surface of the sheet of paper 18. The heat generated by the heat-generating elements 17 is transferred to the fusible ink particles 15 through the anti-tack layer 13 and the substrate 11. More specifically, the ink particles in portions of the ink-bearing medium 10 adjacent to the heat-generating elements 17 are fused or melted, and the molten ink adheres to the printing surface of the paper sheet 18, whereby a matrix of ink dots 19 of a suitable size are formed on the sheet 18, which form an appropriate character such as a letter or a symbol.

As previously indicated, the results of printing performed with the ink-bearing medium 10 are indicated in FIGS. 5 and 6. The printing of FIG. 5 was effected in the following conditions:

| | |
|---|---|
| Printing energy: | 30 m J/mm$^2$ |
| Smoothness of paper 18: | 60 secs. (Bekk smoothness) |
| Ink-bearing medium 10: | |
| Substrate 11 | 6.5-micron thick, polyester |
| Ink layer 12 | 13-14 micron thick |

The printing of FIG. 6 was effected in the same condition as indicated above, except that the smoothness of the paper 18 was 350 secs. (Bekk smoothness).

Reference character A in FIGS. 5 and 6 shows the ink-bearing medium 10 according to the invention, while characters B and C indicate known ink-bearing mediums for thermal printing. FIGS. 5 and 6 reveal that the ink-bearing medium 10 (A) according to the invention is distinctly superior in optical density P of printed images, to the known ink-bearing mediums (B) and (C). With the ink-bearing medium 10, the optical density P is not significantly affected by the smoothness of the paper 18. Further, the instant ink-bearing medium 10 provided improved uniformity of optical density over the entire area of each printed image.

EXAMPLE 2

| | |
|---|---|
| A. Ink Material | 9 parts by weight |
| Palmitic acid | 50 wt. % |
| Candelilla wax | 35 wt. % |
| Carbon black | 10 wt. % |
| Nigrosine Base | 4 wt. % |
| Methyl Violet | 1 wt. % |
| TOTAL | 100 wt. % |
| B. Resin Solution | 25 parts by weight |
| Polyvinyl alcohol | 10 wt. % |
| Polyethylene glycol (#600 available from DAIICHI KOGYO SEIYAKU CO LTD) | 2 wt. % |
| Polyoxyethylene oleyl ether | 2 wt. % |
| Water | 86 wt. % |
| TOTAL | 100 wt. % |
| C. Diluent | 35 parts by weight |

-continued

| | |
|---|---|
| Ethyl alcohol | 100 wt. % |

EXAMPLE 3

| | |
|---|---|
| A. Ink Material | 16 parts by weight |
| Stearic acid | 75 wt. % |
| Candelilla wax | 8 wt. % |
| Castor wax | 5 wt. % |
| Carbon black | 6 wt. % |
| Niglosine Base | 5 wt. % |
| Methyl Violet | 1 wt. % |
| TOTAL | 100 wt. % |
| B. Resin Solution | 29 parts by weight |
| Polyvinyl alcohol | 14 wt. % |
| Water | 86 wt. % |
| TOTAL | 100 wt. % |
| C. Diluent | 45 parts by weight |
| Ethyl alcohol | 100 wt. % |

EXAMPLE 4

| | |
|---|---|
| A. Ink Material | 3 parts by weight |
| Behenic acid | 26 wt. % |
| Palmitic acid | 23 wt. % |
| Candelilla wax | 20 wt. % |
| Carbon black | 20 wt. % |
| Oleic acid | 5 wt. % |
| Niglosine Base | 5 wt. % |
| Methyl Violet | 1 wt. % |
| TOTAL | 100 wt. % |
| B. Resin Solution | 5 parts by weight |
| Polyvinyl alcohol | 12 wt. % |
| Water | 86 wt. % |
| TOTAL | 100 wt. % |
| C. Diluent | 8 parts by weight |
| Ethyl alcohol | 100 wt. % |

The ink-bearing mediums 10 produced according to the foregoing examples, have the fusible ink particles 15 which are evenly distributed in the continuous minute pores which are formed in the porous resin layer 14 of water-soluble resin. The porous structure of the resin layer 14 functions as a barrier to restrict migration of the molten ink particles 15 toward the surface of the ink layer 12. In other word, the porous resin layer 14 will prevent consumption of the entire molten mass of the ink particles 15 in the heated portion of the the ink layer 12, in a single use of the ink-bearing medium 10, thereby permitting the medium 10 to be used multiple times.

Further, the continuity of the ink material in the porous resin layer 14 allows the inner ink particles 15 near the substrate 11 to flow toward the surface of the ink layer 12, thus avoiding a waste of the inner ink particles 15.

As described above, the multiple-use ink-bearing medium 10 according to the invention is far economical than conventional one-time thermal print ribbons or ink-bearing mediums. The following is the comparison of a cost of printing in connection with the ink-bearing medium, when printing operations are performed by using the instant ink-bearing medium 10 and the conventional ink-bearing mediums, where 1200 characters are printed on a high-quality A4-size cut sheet of 45 kg paper which costs 3 yen.

7 yen (including 4 yen for the ink-bearing medium) when the multiple-use ink-bearing medium of the invention is used 20 yen (including 17 yen for the ink-bearing medium) when the conventional single-use or one-time ink-bearing medium is used For reference, it is noted that a commonly used heat-sensitive paper for a thermal printing costs 12 yen.

Furthermore, emulsifying the ink material and the solution of water-soluble resin during preparation of the ink-layer composition for the ink layer 12, facilitates uniform size distribution of the ink particles 15 which are carried by the porous resin layer 14 comprising polyvinyl alcohol as a major constituent. Uniform size of the ink particles 15 assures consistent printing quality with a minimum difference in optical density in different parts of each printed image.

What is claimed is:

1. A reuseable ink-bearing medium containing a thermally-transferable ink for thermal printing, comprising:

a substrate;

a porous resin layer formed on one surface of said substrate and formed of a water-soluble resin comprising polyvinyl alcohol as a major constituent, said porous resin layer having a multiplicity of continuous pores of less than 6 microns; and a fusible ink material contained in said multiplicity of continuous pores in said porous resin layer, said fusible ink material comprising at least one solid saturated fatty acid of a formula: $CH_3(CH_2)_nCOOH$, wherein n=14 through 20 inclusive, a coloring agent and a fusible agent having a low melting point, the proportion of said solid fatty acid to the sum of said solid fatty acid and said fusible agent is within the range of 40–95% by weight.

2. A reuseable ink-bearing medium according to claim 1, wherein the proportion of said solid fatty acid to the sum of said solid fatty acid and said fusible agent is within the range of 58–95 % by weight.

3. A reuseable ink-bearing medium according to claim 1, wherein said solid fatty acid is selected from the group consisting of palmitic acid, margaric acid, stearic acid, nonadecanoic acid, arachic acid and behenic acid.

4. A reuseable ink-bearing medium according to claim 1, wherein said fusible agent is selected from the group of waxy materials consisting of candelilla wax, carnauba wax, castor wax, sorbitan sterate, sorbitan palmitate, oleyramide, stearyramide, and synthetic ester wax.

5. A reuseable ink-bearing medium according to claim 1, wherein said resin layer further comprises at least one material selected from the group consisting of polyethylene glycol, methyl cellulose, ethyl cellulose, hydroxyethyl cellulose, hydroxypropyl cellulose, carboxymethyl cellulose, polyvinyl pyrrolidone, polyacrylic acid soda, polyacrylamide, styrene-maleic anhydride copolymer and isobutylene-maleic anhydride copolymer.

6. A reuseable ink-bearing medium according to claim 1, wherein said substrate is made of a material having a minimum heat resistance of 150° C., selected from the group consisting of polyester, polyimide, polycarbonate, polysulfone, polyether sulfone, polyphenylenesulfide and polyether-ether ketone.

7. A reuseable ink-bearing medium according to claim 1, wherein said substrate is made of a condenser paper or glassine paper.

8. A reuseable ink-bearing medium according to claim 1, wherein the other surface of said substrate is covered with an anti-tack layer made of silicon or a heat resistant resin.

9. A reuseable ink-bearing medium according to claim 1, wherein said fusible ink material further comprises a dispersant for dispersing said coloring agent in said fusible agent.

10. A reuseable ink-bearing medium according to claim 1, wherein said porous resin layer containing said fusible ink material has a thickness of 5–30 microns.

11. A reuseable ink-bearing medium according to claim 1, wherein said coloring agent includes a dye and a pigment.

12. A reuseable ink-bearing medium according to claim 11, wherein said coloring agent comprises said pigment as a major constituent.

13. A reuseable ink-bearing medium according to claim 11, wherein said pigment is selected from the group consisting of carbon black, Lake Red, Alkali Blue Toner and Prussian blue.

14. A reuseable ink-bearing medium according to claim 11, wherein said dye comprises an oil-soluble or basic dye which is soluble in said solid fatty acid.

15. A reuseable ink-bearing medium according to claim 14, wherein said dye is selected from the group consisting of Nigrosine, Oil Black and Methyl Violet.

* * * * *